United States Patent [19]

Gaisser

[11] Patent Number: 4,771,813

[45] Date of Patent: Sep. 20, 1988

[54] WEAVER REED

[75] Inventor: Rudi Gaisser, Reutlingen-Betzingen, Fed. Rep. of Germany

[73] Assignee: C. C. Egelhaaf & Co., Reutlingen-Betzingen, Fed. Rep. of Germany

[21] Appl. No.: 67,226

[22] Filed: Jun. 25, 1987

[30] Foreign Application Priority Data

Jul. 11, 1986 [DE] Fed. Rep. of Germany ..... 3623361

[51] Int. Cl.[4] ..... D03D 49/62

[52] U.S. Cl. ..... 139/192

[58] Field of Search ..... 139/188 R, 192

[56] References Cited

U.S. PATENT DOCUMENTS 3,154,110 10/1964 Rockett ..... 139/192

FOREIGN PATENT DOCUMENTS 2127209 2/1973 Fed. Rep. of Germany .

3121818 3/1983 Fed. Rep. of Germany .

*Primary Examiner*—Henry S. Jaudon

*Attorney, Agent, or Firm*—Michael J. Striker

[57] ABSTRACT

In a weaver reed having a plurality of reed blades insertable in packs into capsules, each capsule has two lateral portions and a bottom portion which is connected to one of the lateral portions by a thin-wall bridge portion which is curved and remains deformable when pressure of a pressing device is applied to a capsule with reed blades inserted therein.

6 Claims, 2 Drawing Sheets

WEAVER REED

BACKGROUND OF THE INVENTION

The present invention relates to a weaver reed provided with reed blades extended parallel to each other and spaced from each other by intervals defined by springs and the ends of which are glued in a gutter-shaped binding capsule in which two external walls extend parallel to each other and parallel to the prepared reed.

In order to secure reed blades or dents in the binding capsule one must consider that individual reed blades preassembled in a pack should be maintained during the fastening operation in an exact parallel position and the external sides of the binding capsule positioned on the opposite sides of the reed should have an exact opposite parallel position and be parallel to the plane of the reed. The fastening takes place by means of a glue applied into the binding capsule and hardenable therein.

A two part binding capsule has been disclosed in DE-OS No. 2127 209. This known capsule is subdivided into two halves hingeable relative one another. A precise parallel position of the external walls of the capsule can be reached only when the small width of the gutter-shaped capsule is precisely adjusted to the width of the reed blades. Due to unavoidable allowances such a precise adjustment cannot be practically achieved so that during the compressing of two hingeable capsule halves the parallel position of the external walls of the binding capsule is either not obtained or this parallel position of the reed blades is distorted.

The binding capsule disclosed in DE-PS No. 31 21 818 is subdivided into two portions, and for this purpose a portion which overlaps at least one of the capsule halves sealingly connects those halves to each other, and external walls of the capsule halves are placed in a desired parallel position during the compressing process. The problem which occurs with this conventional device is that, due to the utilization of certain glue materials, a sealing at the overlapping portion can damage a rational application of the binding capsule to the pack of reed blades.

SUMMARY OF THE INVENTION

It is an object of the present invention to provide an improved weaver reed.

It is another object of the invention to provide a reed with a binding capsule which would ensure in each case, and also independently from tolerance fluctuations of the springs holding together a pack of reed blades, a parallel position of both external walls of the binding capsule, and with which the flowing out of the glue from the binding capsule, before hardening of the glue and securing the binding capsule, would be impossible.

These and other objects of the invention are attained by a weaver reed comprising a plurality of reed blades extended parallel to each other and spaced from each other at intervals defined by springs, and binding capsules, said reed blades having ends glued in said binding capsules, said capsules each including two external walls which extend parallel to each other when said reed blades are inserted into said capsules and parallel to a plane of said reed blades, at least a lower capsule having a first portion and a second portion spaced from each other and forming said external walls, and a bottom portion, one of said first and second portions which forms one of said external walls being connected to said second portion and said lower portion by a thin-wall bridge portion which remains deformable under pressure to be applied to said capsule by a pressing device.

Due to the provision of the bridge portion, a one-piece binding capsule having no openings is formed so that the glue would not be permitted to flow out from the capsule. At the same time, the capsule portion which is adjacent to the bridge portion not only can be pivoted to a required position parallel to the opposite capsule portion but also this portion is more or less displaceable because the bridge portion remains deformable when the compressing device is applied to a pre-assembled reed with the reed blades inserted into the capsule.

The deformable bridge portion may extend over the entire length of said capsule and form a closing wall.

One portion of the capsule may include only one side wall and another of said first and second portions may include only one side wall, said bottom portion extending perpendicular to said one only side wall of said second portion, said reed blades when inserted into said capsule lying at ends thereof on said bottom portion.

The thin-wall deformable portion may be formed at a free longitudinal edge of said lower portion and is outwardly convexly curved and is spaced from two opposite sides of said bottom portion. The deformation of the bridge portion during the assembling process thus takes place due to a greater or lesser change in the convexity of the bridge portion.

The capsule first and second portion may each have at an internal side thereof an elongated groove for receiving springs of a pack of the reed blades, and wide abutment ribs spaced from each other to form therebetween grooves for receiving glue.

The width of said capsule in a non-pressed condition is selected so that the ends of said pack of reed blades inserted into said capsule extend over the entire width of said bottom portion and over a part of the width of said bridge portion.

The second one of the portions of the capsule may be inclined outwardly relative to said bottom portion when said binding capsule is in a non-pressed condition so that due to the deformation of the bridge portion the second one of said portions can be placed in a required position parallel to the first portion when pressure is applied to that second portion by a compressing device.

When the pressing or compressing is released after the glue in the capsule has been hardened the lateral walls of the capsule with the reed blades inserted therein and connected thereto with glue lie exactly parallel to each other and to the plane of the reed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
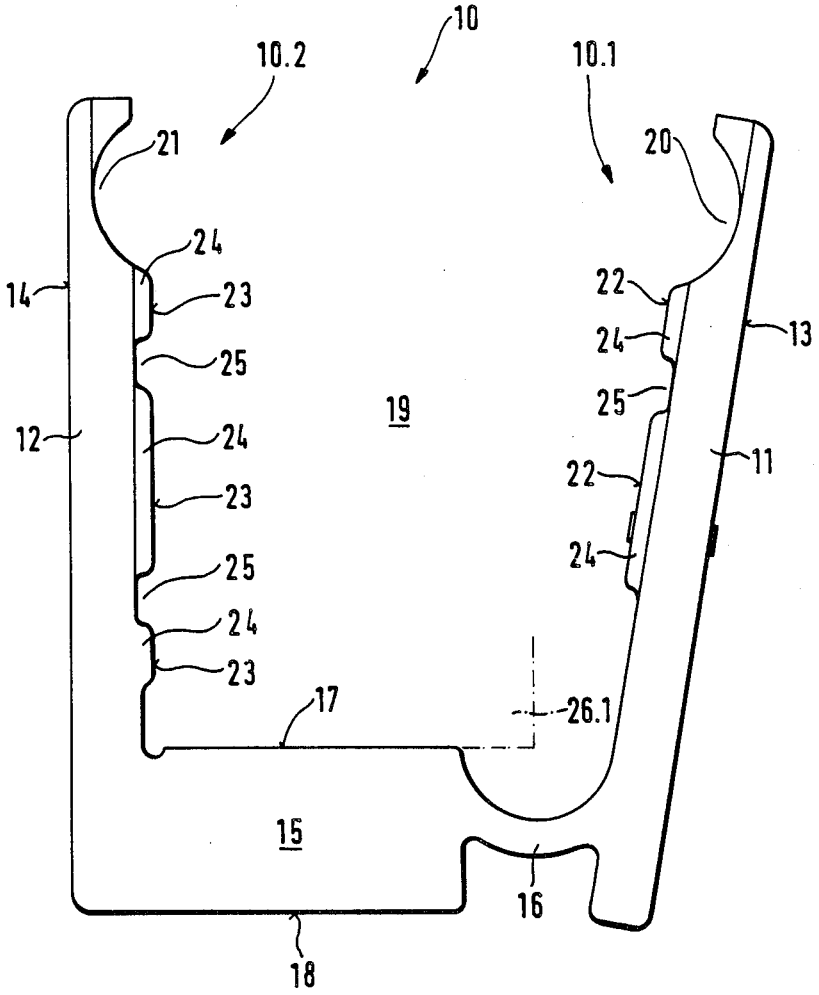
FIG. 1 is a cross-section through a gutter-shaped binding capsule in an initial position.

Referring now to the drawings in detail, and firstly to FIG. 1 thereof, it will be seen that a binding capsule 10 is gutter-shaped in cross-section and has a first portion 10.1 and a second portion 10.2. The smaller capsule portion 10.1 forms only one side wall 11 of the two side walls 11 and 12 of the capsule. The external side of the side wall 11 which forms one external wall of the gutter-shaped capsule is designated with reference numeral 13. The greater capsule portion 10.2 has, in addition to the side wall 12, which forms the other external wall 14 of the binding capsule, a thick bottom wall 15 provided at the lower end of the side wall 12 and extending transversely thereto. The side wall 11 is connected with the end of the bottom wall 15 by a continual or non-interrupted bridge portion 16 which extends over the entire length of the gutter-shaped binding capsule 10. This bridge portion is formed by a thin outwardly convexly-curved wall which rearwardly extends from the internal side 17 and external side 18 of the bottom wall 15.

Both side walls 11 and 12 of the binding capsule 10 have each at the inner side a groove 20, 21, respectively, which groove each has a circular-segment cross-section and opens towards interior 19 of the capsule. Further a plurality of webs or projections 24 of different width and different quantity are formed at the internal sides of the side walls 11 and 12. Webs 24 extend parallel to the external walls 13 and 14, respectively and form abutment wall portions 22 and 23, respectively. Elongated grooves 25 in which a hardenable glue material can be applied, result between webs 22 and 23 at each internal wall of the capsule.

The side wall 11 which is outwardly inclined or sloped in the initial position of the binding capsule shown in FIG. 1 allows for an easy insertion of the pre-fabricated reed blade pack of the weaver reed, in which individual reed blades are maintained in its end region parallel to each other and in spaced relationship with each other by springs 30, into the interior 19 of the binding capsule 10 despite the overhanging springs 30, whereby the ends of the reed blades or dents can come in contact with the bottom wall 15 and the abutment wall regions 23 of the side wall 12 of the larger capsule portion 10.2. The internal space 19 of the capsule can be at its both ends filled with glue in the non-shown but known fashion without fear that the glue would flow out of the bottom region of the capsule. The binding capsule 10 is dimensioned relative to the width of the reed blades so that the reed blades extend over the entire width of the internal side 17 of the bottom wall 15 and project only over a part of the width of the bridge portion 16 as shown in FIG. 2, namely by the corner 26.1 of the reed blade.

Figure 2:
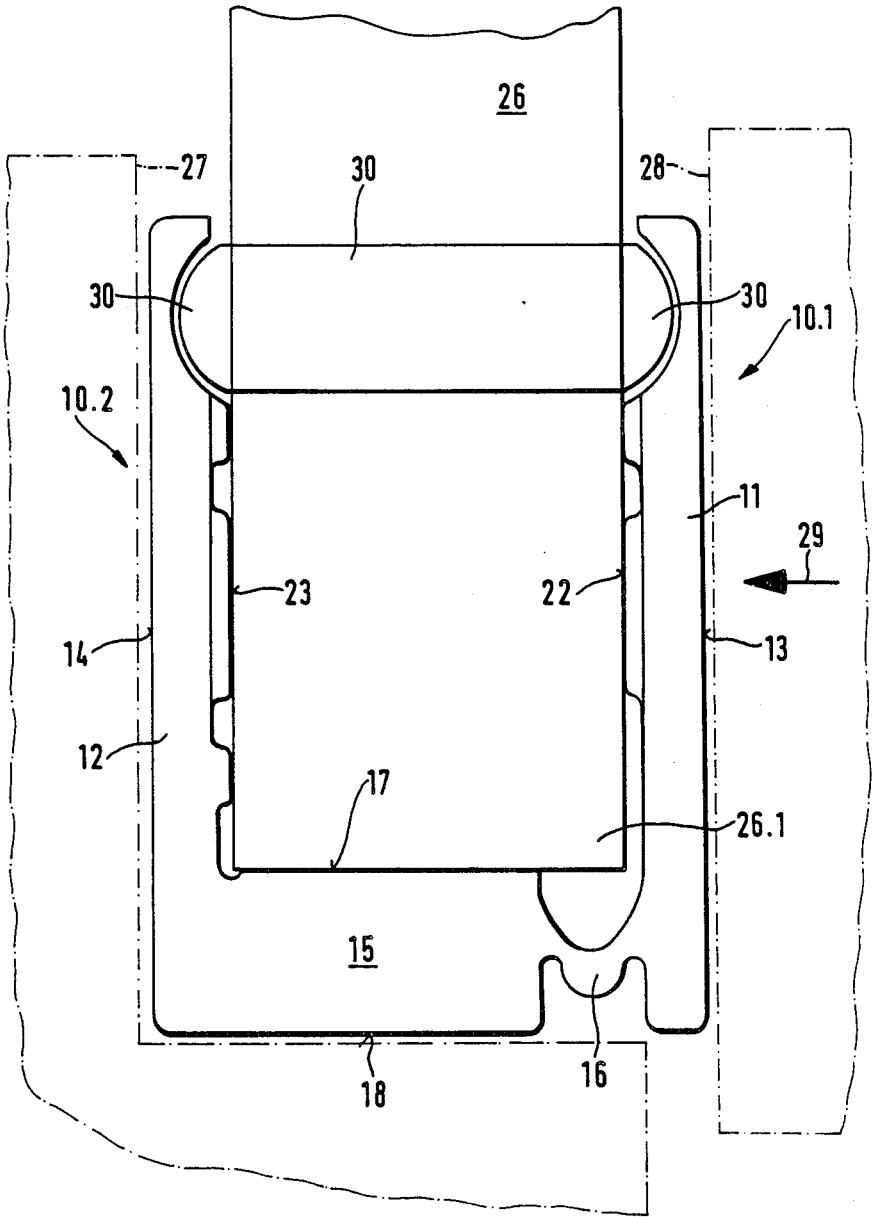
FIG. 2 is a cross-section through the binding capsule in the end position with reed blades of the weaver reed rigidly connected therewith.

After the insertion of the pack of the reed blades into the binding capsule 10 filled with the glue, the pressing device shown in FIG. 2 with dash-dotted lines and designated with reference numeral 28 and having a pressing strip movable in the direction of arrow 29, will bring the capsule portion 10.1, via the pressing strip and under the deformation of the bridge portion 16, to the position in which the internal abutment wall region or surface 22 would come in contact with the reed blades 26, and the capsule portion 10.1 will be maintained in this position until the glue will harden. The external wall 13 of the side wall 11 and the external wall 14 of the side wall 12 are now placed in their exact parallel position which is possible due to deforming of the bridge portion 16. The projecting heads of springs 30 extend into elongated grooves 20 and 21 of side walls 11 and 12. Reference numeral 27 denotes a support part of the movable part 28 of the pressing device.

It will be understood that each of the elements described above, or two or more together, may also find a useful application in other types of weaver reeds differing from the types described above.

While the invention has been illustrated and described as embodied in a weaver reed, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims

1. A reed comprising a plurality of reed blades extended parallel to each other and spaced from each other at intervals defined by springs, and binding capsules, said reed blades having ends glued in said binding capsules, said capsules each being formed of one piece and including a first portion (10.2) forming a first external wall, a second portion (10.1) forming a second external wall spaced from said first external wall, and a bottom portion extending perpendicular to said first external wall, said reed blades when inserted into a respective one of said capsules lying at ends thereof on said bottom portion, said second portion being connected to said bottom portion by a thin-wall bridge portion which becomes and remains deformable when pressure is applied to said capsule by a pressing device in order to bring said second external wall in contact with said reed blades and to a position parallel to said first external wall.

2. The reed as defined in claim 1, wherein said bridge portion extends over the entire length of said capsule and forms a closing wall.

3. The reed as defined in claim 1, wherein said thin-wall bridge portion (16) is formed at a longitudinal edge of said bottom portion and is outwardly convexly curved and is spaced from two opposite sides (17, 18) of said bottom portion.

4. The reed as defined in claim 3, wherein said first and second portion each has at an internal side thereof an elongated groove (20, 21) for receiving springs (30) of a pack of the reed blades, and wide abutment ribs (24) spaced from each other to form therebetween grooves (25) for receiving glue.

5. The reed as defined in claim 4, wherein said the width of said capsule in a non-pressed condition is selected so that the ends of said pack of reed blades (26) inserted into said capsule (10) extend over the entire width of said bottom portion and over a part of the width of said bridge portion.

6. The reed as defined in claim 5, wherein said second portion (10.1) is inclined to said bottom portion when said binding capsule is in a non-pressed condition.

* * * * *